US009917406B1

(12) United States Patent
Iwasaki et al.

(10) Patent No.: US 9,917,406 B1
(45) Date of Patent: Mar. 13, 2018

(54) SHIELDING STRUCTURE FOR A CONTACT MODULE HAVING A GROUND CLIP

(71) Applicants: TE CONNECTIVITY CORPORATION, Berwyn, PA (US); TYCO ELECTRONICS JAPAN G.K., Kawasaki-shi (JP)

(72) Inventors: Masaaki Iwasaki, Yokohama (JP); Chad William Morgan, Carneys Point, NJ (US); Yoshihiko Kodaira, Fujisawa (JP); Justin Dennis Pickel, Hummelstown, PA (US); Masayuki Aizawa, Machida (JP)

(73) Assignees: TE CONNECTIVITY CORPORATION, Berwyn, PA (US); TYCO ELECTRONICS JAPAN G.K., Kawasaki-Shi (JP)

( * ) Notice: Subject to any disclaimer, the term of this patent is extended or adjusted under 35 U.S.C. 154(b) by 0 days.

(21) Appl. No.: 15/417,474

(22) Filed: Jan. 27, 2017

(51) Int. Cl.

| | |
|---|---|
| ***H01R 13/658*** | (2011.01) |
| ***H01R 13/6587*** | (2011.01) |
| ***H01R 12/73*** | (2011.01) |
| *H01R 13/6585* | (2011.01) |
| *H01R 13/6594* | (2011.01) |
| *H01R 13/6586* | (2011.01) |

(52) U.S. Cl.
CPC ..... *H01R 13/6587* (2013.01); *H01R 12/737* (2013.01); *H01R 13/658* (2013.01); *H01R 13/6585* (2013.01); *H01R 13/6586* (2013.01); *H01R 13/6594* (2013.01)

(58) Field of Classification Search
CPC ..... H01R 13/658; H01R 13/6585; H01R 13/6586; H01R 13/6587; H01R 13/6594
USPC ..... 439/607.05, 607.06, 607.07, 607.08, 439/607.09, 607.11, 607.53
See application file for complete search history.

(56) References Cited

U.S. PATENT DOCUMENTS

| | | | | |
|---|---|---|---|---|
| 6,116,926 | A * | 9/2000 | Ortega | H01R 13/6586 439/108 |
| 6,843,687 | B2 | 1/2005 | McGowan et al. | |
| 8,183,466 | B2 | 5/2012 | Morlion et al. | |
| 8,398,434 | B2 | 3/2013 | Davis et al. | |
| 8,444,434 | B2 | 5/2013 | Davis et al. | |
| 8,579,636 | B2 | 11/2013 | Davis et al. | |
| 8,591,260 | B2 | 11/2013 | Davis et al. | |
| 8,690,604 | B2 * | 4/2014 | Davis | H01R 23/688 439/607.07 |
| 8,771,017 | B2 | 7/2014 | Vino, IV et al. | |
| 8,777,663 | B2 | 7/2014 | Annis et al. | |
| 8,992,252 | B2 | 3/2015 | McClellan et al. | |
| 9,331,407 | B2 | 5/2016 | Laurx et al. | |

(Continued)

*Primary Examiner* — Abdullah Riyami
*Assistant Examiner* — Justin Kratt

(57) ABSTRACT

A contact module includes a dielectric holder holding signal contacts with mating portions and a shield structure providing electrical shielding for the signal contacts. The shield structure has first and second ground shields. The ground shields have mating portions extending forward of a mating end of the dielectric holder. The shield structure has a ground clip at least partially covering the mating end of the dielectric holder and extending between sides thereof to electrically connect the mating portions of the first ground shield and the mating portions of the second ground shield immediately forward of the mating end of dielectric holder.

20 Claims, 13 Drawing Sheets

(56) References Cited

U.S. PATENT DOCUMENTS

| | | | | |
|---|---|---|---|---|
| 2001/0012730 | A1* | 8/2001 | Ramey ..... | H01R 12/585<br>439/607.05 |
| 2016/0181732 | A1 | 6/2016 | Laurx et al. | |

* cited by examiner

SHIELDING STRUCTURE FOR A CONTACT MODULE HAVING A GROUND CLIP

BACKGROUND OF THE INVENTION

The subject matter herein relates generally to shielding structures for contact modules of electrical connectors.

Some electrical systems utilize electrical connectors, such as header assemblies and receptacle assemblies, to interconnect two circuit boards, such as a motherboard and daughtercard. Some known electrical connectors include a front housing holding a plurality of contact modules arranged in a contact module stack. The electrical connectors provide electrical shielding for the signal conductors of the contact modules. For example, ground shields may be provided on one or both sides of each contact module. However, at high speeds, the electrical shielding of known electrical connectors may be insufficient. For example, while the ground shield(s) may provide shielding along the sides of the signal conductors, known electrical connectors do not provide sufficient additional electrical shielding above and/or below the signal conductors throughout the length of the contact modules. For example, the additional electrical shielding may only be provided at the mating interface with the mating electrical connector and not along the length of the signal conductors between the mating end and the mounting end mounted to the circuit board.

Furthermore, for contact modules that provide pairs of signal conductors arranged in the same row, rather than the same column, shielding between the pairs of signal conductors is difficult and/or expensive. For example, some known electrical connectors provide contact modules with conductive shells that provide some additional shielding. However, the shells are plated plastic or die cast shells that can add significant cost to the contact modules.

A need remains for a shielding structure for contact modules along significant lengths of the signal contacts thereof to provide electrical shielding between pairs of the signal contacts.

BRIEF DESCRIPTION OF THE INVENTION

In one embodiment, a contact module is provided including a dielectric holder having first and second sides extending between a mating end and a mounting end and signal contacts being held by the dielectric holder. The signal contacts have mating portions extending forward of the mating end, mounting portions extending from the mounting end for termination to a circuit board, and transition portions extending through the dielectric holder between the mating and mounting portions. A shield structure is coupled to the dielectric holder for providing electrical shielding for the signal contacts. The shield structure has a first ground shield provided at the first side of the dielectric holder and a second ground shield provided at the second side of the dielectric holder. The first ground shield has mating portions extending forward of the mating end of the dielectric holder and provides electrical shielding for the mating portions of the signal contacts. The second ground shield has mating portions extending forward of the mating end of the dielectric holder and provides electrical shielding for the mating portions of the signal contacts. The shield structure has a ground clip at least partially covering the mating end of the dielectric holder and extending between the first and second sides to electrically connect each of the mating portions of the first ground shield and each of the mating portions of the second ground shield immediately forward of the mating end of dielectric holder.

In another embodiment, a shield structure is provided for a contact module having a dielectric holder holding signal contacts arranged in pairs carrying differential signals and having mating portions extending forward of the dielectric holder for mating with a mating electrical connector. The shield structure includes a first ground shield having a main body configured to extend along a first side of the dielectric holder. The main body has a plurality of rails separated by gaps and including side strips configured to extend along the side of the dielectric holder and connecting strips configured to extend into the dielectric holder. Each rail has a mating portion extending from the main body forward of the dielectric holder for providing electrical shielding for the mating portions of the corresponding signal contacts. The shield structure includes a second ground shield having a main body configured to extend along a second side of the dielectric holder. The second ground shield has mating portions extending from the main body forward of the dielectric holder for providing electrical shielding for the mating portions of the corresponding signal contacts. The shield structure includes a ground clip at least partially covering a mating end of the dielectric holder. The ground clip extends between the first and second ground shields to electrically connect each of the mating portions of the first ground shield and each of the mating portions of the second ground shield rearward of the mating portions of the first and second ground shields.

In a further embodiment, an electrical connector is provided including a housing having a mating end and contact modules arranged in a contact module stack received in and extending from the housing for termination to a circuit board. Each contact module includes a dielectric holder having first and second sides extending between a mating end and a mounting end and signal contacts being held by the dielectric holder. The signal contacts have mating portions extending forward of the mating end, mounting portions extending from the mounting end for termination to a circuit board, and transition portions extending through the dielectric holder between the mating and mounting portions. A shield structure is coupled to the dielectric holder for providing electrical shielding for the signal contacts. The shield structure has a first ground shield provided at the first side of the dielectric holder and a second ground shield provided at the second side of the dielectric holder. The first ground shield has mating portions extending forward of the mating end of the dielectric holder and provides electrical shielding for the mating portions of the signal contacts. The second ground shield has mating portions extending forward of the mating end of the dielectric holder and provides electrical shielding for the mating portions of the signal contacts. The shield structure has a ground clip at least partially covering the mating end of the dielectric holder and extending between the first and second sides to electrically connect each of the mating portions of the first ground shield and each of the mating portions of the second ground shield immediately forward of the mating end of dielectric holder.

DETAILED DESCRIPTION OF THE INVENTION

Figure 1:
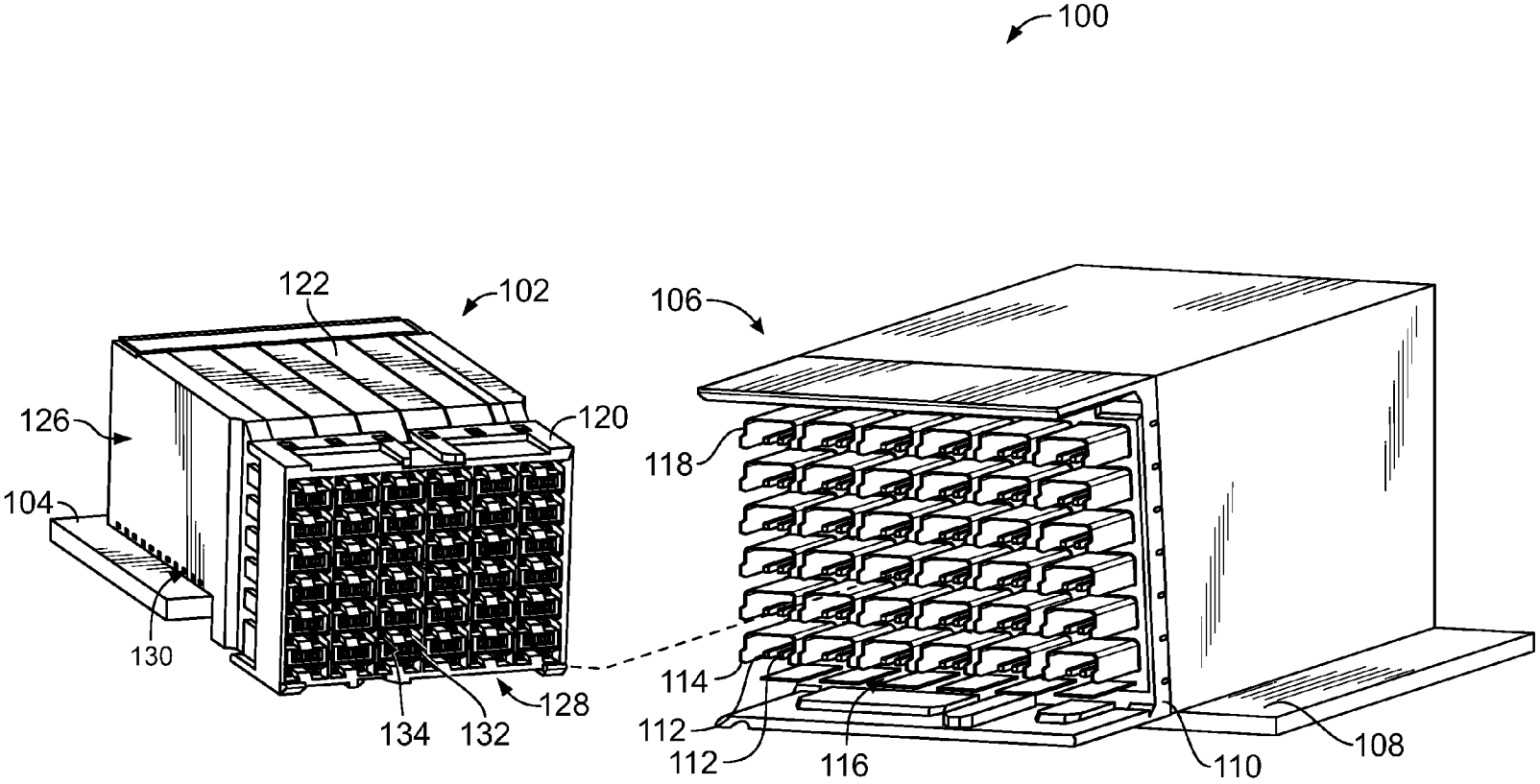
FIG. 1 is a front perspective view of an electrical connector system having an electrical connector formed in accordance with an exemplary embodiment.

FIG. 1 is a front perspective view of an electrical connector system 100 formed in accordance with an exemplary embodiment. The connector system 100 includes an electrical connector 102 configured to be mounted to a circuit board 104 and a mating electrical connector 106, which may be mounted to a circuit board 108. The mating electrical connector 106 may be a header connector. Various types of connector assemblies may be used in various embodiments, such as a right angle connector, a vertical connector or another type of connector.

The mating electrical connector 106 includes a housing 110 holding a plurality of mating signal contacts 112 and mating ground shields 114. The mating signal contacts 112 may be arranged in pairs 116. Each mating ground shield 114 extends around corresponding mating signal contacts 112, such as the pairs 116 of mating signal contacts 112. In the illustrated embodiment, the mating ground shields 114 are C-shaped having three walls extending along three sides of each pair of mating signal contacts 112. The mating ground shield 114 adjacent to the pair 116 provides electrical shielding along a fourth side of the pair 116. As such, the pairs 116 of mating signal contacts 112 are circumferentially surrounded on all four sides by the mating ground shields 114. The mating ground shields 114 extend to edges 118.

The electrical connector 102 includes a housing 120 that holds a plurality of contact modules 122. The contact modules 122 are held in a stacked configuration generally parallel to one another. The contact modules 122 may be loaded into the housing 120 side-by-side in the stacked configuration as a unit or group. Any number of contact modules 122 may be provided in the electrical connector 102. The contact modules 122 each include a plurality of signal contacts 124 (shown in FIG. 2) that define signal paths through the electrical connector 102. The signal contacts 124 are configured to be electrically connected to corresponding mating signal contacts 112 of the mating electrical connector 106.

The electrical connector 102 includes a mating end 128, such as at a front of the electrical connector 102, and a mounting end 130, such as at a bottom of the electrical connector 102. In the illustrated embodiment, the mounting end 130 is oriented substantially perpendicular to the mating end 128. The mating and mounting ends 128, 130 may be at different locations other than the front and bottom in alternative embodiments. The signal contacts 124 extend through the electrical connector 102 from the mating end 128 to the mounting end 130 for mounting to the circuit board 104.

The signal contacts 124 are received in the housing 120 and held therein at the mating end 128 for electrical termination to the mating electrical connector 106. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. Optionally, the signal contacts 124 may be arranged in pairs carrying differential signals; however other signal arrangements are possible in alternative embodiments, such as single-ended applications. Optionally, the pairs of signal contacts 124 may be arranged in rows (pair-in-row signal contacts); however, the pairs of signal contacts may be arranged in columns (pair-in-column signal contacts) in alternative embodiments. The signal contacts 124 within each pair may be contained within the same contact module 122.

In an exemplary embodiment, each contact module 122 has a shield structure 126 for providing electrical shielding for the signal contacts 124. The shield structure is configured to be electrically connected to the mating ground shields 114 of the mating electrical connector 106. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts 124. The contact modules 122 provide shielding for each pair of signal contacts 124 along substantially the entire length of the signal contacts 124 between the mating end 128 and the mounting end 130. In an exemplary embodiment, the shield structure 126 is configured to be electrically connected to the mating electrical connector and/or the circuit board 104. The shield structure 126 may be electrically connected to the circuit board 104 by features, such as grounding pins and/or surface tabs.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding mating signal contacts 112 of the mating electrical connector 106. In the illustrated embodiment, the ground contact openings 134 are C-shaped extending along three sides of the corresponding pair of signal contact openings 132. The ground contact openings 134 receive mating ground shields 114 of the mating electrical connector 106. The ground contact openings 134 also receive portions of the shield structure 126 (for example, beams and/or fingers) of the contact modules 122 that mate with the mating ground shields 114 to electrically common the shield structure 126 with the mating electrical connector 106.

The housing 120 is manufactured from a dielectric material, such as a plastic material, and provides isolation between the signal contact openings 132 and the ground contact openings 134. The housing 120 isolates the signal contacts 124 from the shield structure 126. The housing 120 isolates each set (for example, differential pair) of signal contacts 124 from other sets of signal contacts 124.

Figure 2:
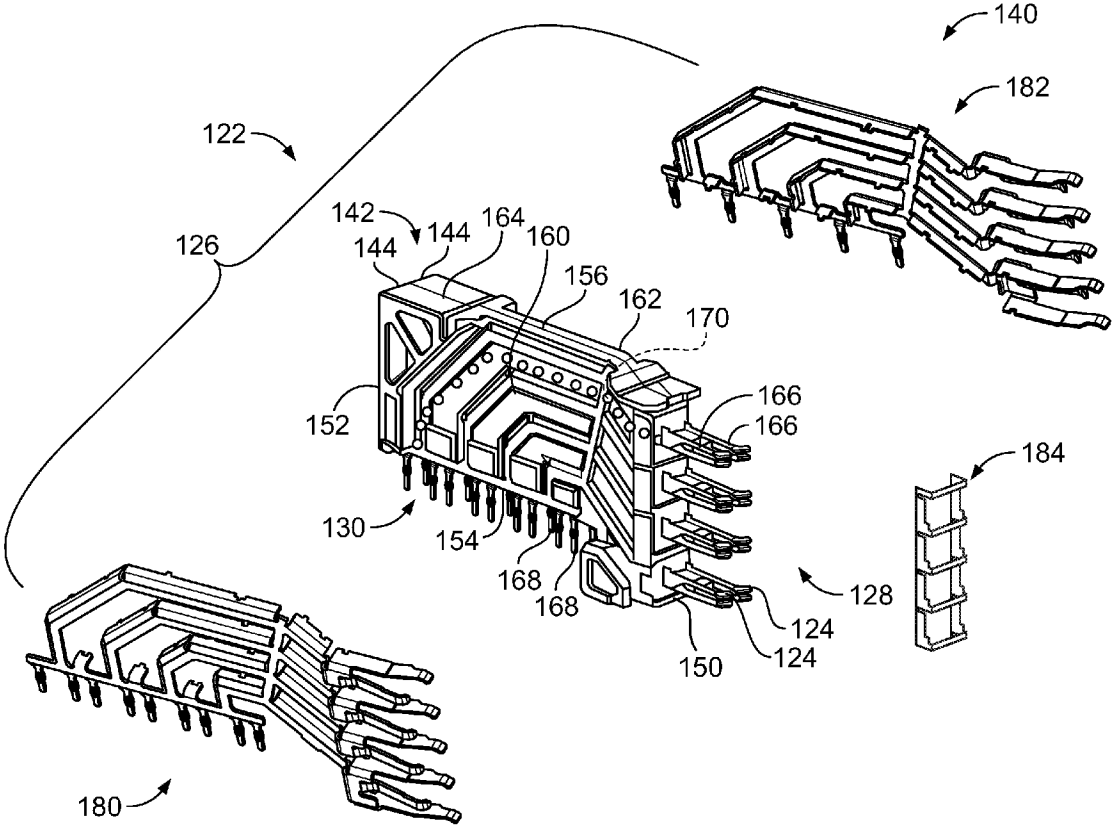
FIG. 2 is an exploded view of a contact module of the electrical connector in accordance with an exemplary embodiment.
Figure 3:
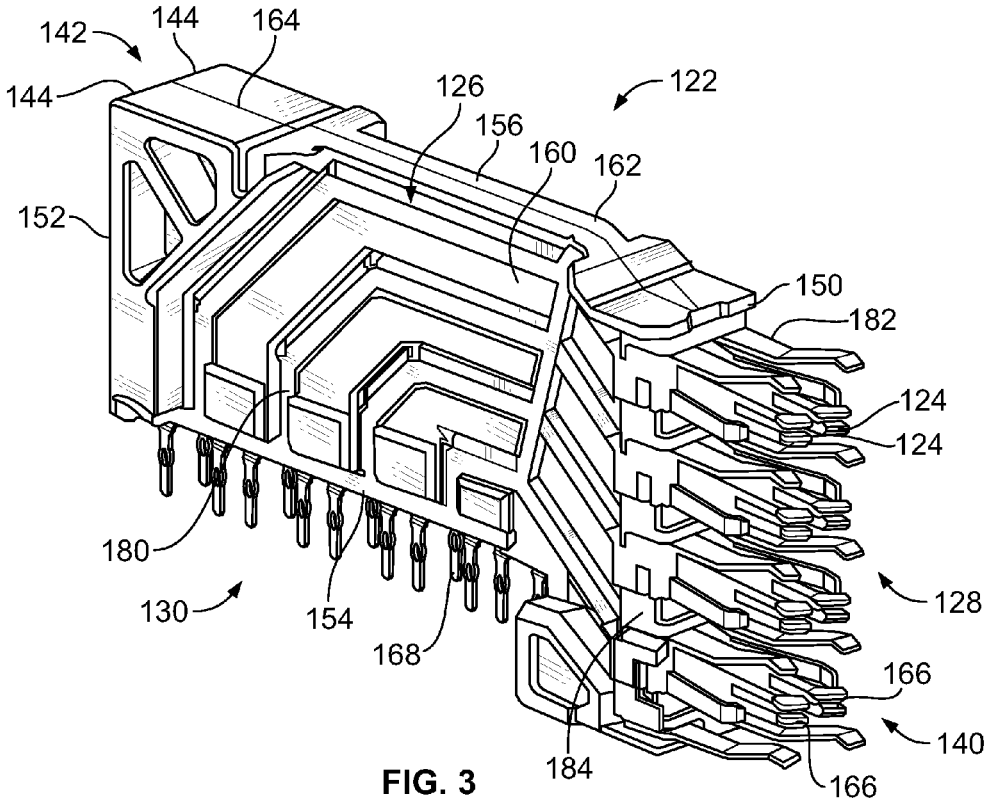
FIG. 3 is an assembled view of the contact module.

FIG. 2 is an exploded view of one of the contact modules 122 in accordance with an exemplary embodiment. FIG. 3 is an assembled view of the contact module 122. The contact module 122 includes a frame assembly 140 having an array of the signal contacts 124 and a dielectric holder 142 holding the signal contacts 124. The dielectric holder 142 generally surrounds the signal contacts 124 along substantially the entire length of the signal contacts 124 between the mounting end 130 at the bottom and the mating end 128 at the front. The shield structure 126 is coupled to the dielectric holder 142 to provide electrical shielding for the signal contacts 124, such as for each pair of the signal contacts 124. The shield structure 126 provides circumferential shielding for each pair of signal contacts 124 along at least a majority of a length of the signal contacts 124, such as substantially an entire length of the signal contacts 124.

In an exemplary embodiment, the frame assembly 140 is assembled together from two contact sub-assemblies. For example, the dielectric holder 142 may be a two-piece holder formed from two dielectric bodies 144 arranged side-by-side. Each dielectric body 144 surrounds a corresponding array of signal contacts 124. The dielectric body 144 may be overmolded over the signal contacts 124 (for example, each dielectric body 144 may be overmolded over a set of the signal contacts 124 to form one of the contact sub-assemblies). Optionally, the signal contacts 124 may be initially formed from a leadframe and overmolded by the corresponding dielectric body 144 such that portions of the signal contacts 124 are encased in the dielectric holder 142.

The dielectric holder 142 has a mating end 150 at a front thereof configured to be loaded into the housing 120 (shown in FIG. 1), a rear 152 opposite the mating end 150, a mounting end 154 at a bottom which optionally may be adjacent to the circuit board 104 (shown in FIG. 1), and a top 156 generally opposite the mounting end 154. The dielectric holder 142 also includes first and second sides, such as a right side 160 and a left side 162. The shield structure 126 is coupled to both the right and left sides 160, 162. The dielectric bodies 144 include respective interior sides 164 facing and abutting each other. Each dielectric body 144 holds one of the signal contacts 124 from each pair such that the pair has signal contacts 124 in both contact sub-assemblies. When assembled, the signal contacts 124 in each pair are aligned with each other and follow similar paths between the mating and mounting ends 128, 130. For example, the signal contacts 124 have similar shapes and thus have similar lengths, which reduces or eliminates skew in the signal paths for the pairs. The pair-in-row arrangement may enhance the electrical performance of the contact module 122 as compared to pair-in-column contact modules having the signal contacts of each pair radially offset from each other (for example, one radially inside and the other radially outside), leading to skew problems.

The signal contacts 124 may be stamped and formed from a sheet of metal material. Each signal contact 124 has a mating portion 166 extending forward from the mating end 150 of the dielectric holder 142 and a mounting portion 168 extending downward from the mounting end 154. The mating and mounting portions 166, 168 are exposed beyond the front and the bottom, respectively, of the dielectric holder 142. Each signal contact 124 has a transition portion 170 (one of which is shown in phantom in FIG. 2) between the mating and mounting portions 166, 168. The transition portions 170 each include a top, a bottom, a right side, and a left side. In an exemplary embodiment, the top, bottom, and corresponding outer side are each configured to be shielded by the shield structure 126. The mating portions 166 are configured to be electrically terminated to corresponding mating signal contacts 112 (shown in FIG. 1) when the electrical connector 102 is mated to the mating electrical connector 106 (shown in FIG. 1). In an exemplary embodiment, the mounting portions 168 include compliant pins, such as eye-of-the-needle pins, configured to be terminated to the circuit board 104 (shown in FIG. 1).

In an exemplary embodiment, the shield structure 126 includes first and second ground shields 180, 182 and a ground clip 184. The ground clip 184 is configured to be assembled to the dielectric holder 142, such as immediately forward of the mating end 150 of the dielectric holder 142. In an exemplary embodiment, the ground clip 184 spans or covers the mating end 150 of the dielectric holder 142 between the right and the left sides 160, 162. The ground clip 184 is configured to be positioned between the mating ground shields 114 (FIG. 1) and the dielectric holder 142 and is thus positioned adjacent the mating zone between the signal contacts 124 and the mating signal contacts 112 (FIG. 1). The ground clip 184 is configured to be electrically connected to the first and second ground shields 180, 182 such that the ground shields 180, 182 are electrically commoned adjacent the mating zone. Optionally, the ground clip 184 may be used to mechanically secure the first ground shield 180 and/or the second ground shield 182 to the contact module 122. The ground clip 184 provides electrical shielding for the signal contacts 124 at the exit/entrance points of the signal contacts 124 from the dielectric holder 142. The ground clip 184 provides electrical shielding for the mating portions 166 of the signal contacts 124 adjacent the mating zone.

The first and second ground shields 180, 182 cooperate to provide circumferential shielding for each pair of signal contacts 124 along the length thereof. The first ground shield 180 is positioned along the right side 160 of the dielectric holder 142, and as such, may be hereinafter referred to as the right ground shield 180. The second ground shield 182 is positioned along the left side 162 of the dielectric holder 142, and may be hereinafter referred to as the left ground shield 182. The first and second ground shields 180, 182 electrically connect the contact module 122 to the mating electrical connector 106, such as to the mating ground shields 114 thereof (shown in FIG. 1), thereby providing an electrically common ground path between the electrical connector 102 and the mating electrical connector 106. The first and second ground shields 180, 182 electrically connect the contact module 122 to the circuit board 104, such as through compliant pins thereof. The first and second ground shields 180, 182 may be similar and include similar features and components. As such, the description below may include description of either ground shield, which may be relevant to the other ground shield, and like components may be identified with like reference numerals.

Figure 4:
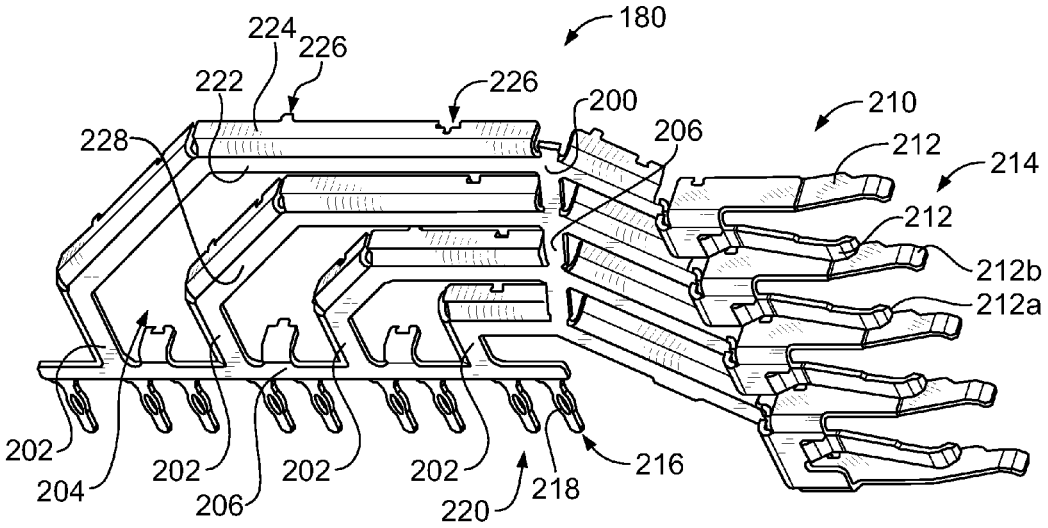
FIG. 4 is a perspective view of a ground shield of the contact module in accordance with an exemplary embodiment.

FIG. 4 is a perspective view of the first ground shield 180 in accordance with an exemplary embodiment. In an exemplary embodiment, the first ground shield 180 is stamped and formed from a stock piece of metal material. The first ground shield 180 includes a main body 200 configured to extend along the right side 160 of the dielectric holder 142 (both shown in FIG. 2). The main body 200 includes a plurality of right side rails 202 separated by right side gaps 204, the right side rails 202 being interconnected by struts 206 that span the gaps 204 between the right side rails 202.

The first ground shield 180 includes mating portions 210 defined by mating beams 212 at a mating end 214 of the main body 200. The mating portions 210 are configured to be mated with corresponding mating portions of the mating electrical connector 106 (for example, the C-shaped mating ground shields 114, shown in FIG. 1). In an exemplary embodiment, the first ground shield 180 includes side mating beams 212*a* and top mating beams 212*b* configured to extend along the sides and the tops of the corresponding signal contacts 124. The mating beams 212 may be deflectable mating beams, such as spring beams. Optionally, the mating beams 212 are configured to be received inside the corresponding C-shaped mating ground shields 114 of the mating electrical connector 106. Alternatively, the mating beams 212 are configured to extend along the outside of the corresponding C-shaped mating ground shields 114 of the mating electrical connector.

The first ground shield 180 includes mounting portions 216 defined by compliant pins 218 at a mounting end 220 of the main body 200. The mounting portions 216 are configured to be terminated to the circuit board 104 (shown in FIG. 1). For example, the mounting portions 216 are configured to be received in plated vias in the circuit board 104.

The right side rails 202 are configured to provide shielding around corresponding signal contacts 124 (shown in FIG. 2). For example, in an exemplary embodiment, the right side rails 202 have side strips 222 configured to extend along the right side 160 of the dielectric holder 142, and connecting strips 224 configured to extend into the dielectric holder 142 and extend between adjacent signal contacts 124. The connecting strips 224 are bent perpendicular to and extend from the corresponding side strips 222. The right side rails 202 form right angle shielded spaces that receive corresponding signal contacts 124 to provide electrical shielding along the sides of the signal contacts 124 and between the signal contacts 124, such as above and/or below corresponding signal contacts 124. The struts 206 interconnect the right side rails 202 to hold the relative positions of the right side rails 202. The gaps 204 are defined between the right side rails 202 and generally follow the paths of the right side rails 202.

In an exemplary embodiment, each connecting strip 224 includes a commoning feature 226 for electrically connecting to the second ground shield 182 (shown in FIG. 2). In the illustrated embodiment, the commoning features 226 are commoning tabs that extend outward from the connecting strips 224 and commoning slots; however, other types of commoning features may be used in alternative embodiments, such as channels, spring beams, and the like. The commoning features 226 may be deflectable to engage and securely couple the first ground shield 180 to the second ground shield 182 when mated thereto. For example, the commoning features 226 may be clips.

The right side rails 202 are configured to extend along and follow the paths of the signal contacts 124, such as between the mating end 128 and the mounting end 130 (both shown in FIG. 1) of the electrical connector 102. For example, the right side rails 202 may transition from the mating end 214 to the mounting end 220 and have different segments or portions 228 that are angled relative to each other as the right side rails 202 transition between the mating and mounting ends 214, 220.

Figure 5:
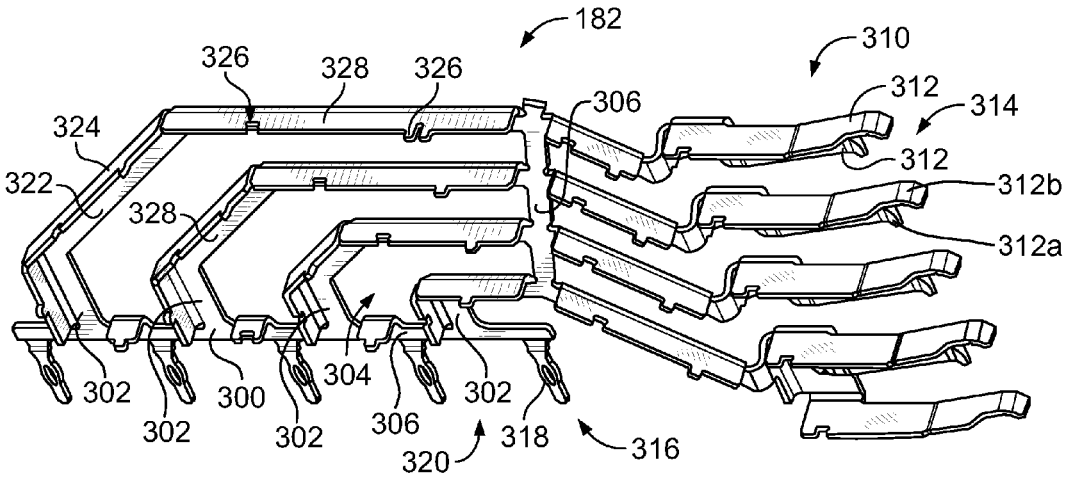
FIG. 5 is a perspective view of a ground shield of the contact module in accordance with an exemplary embodiment.

FIG. 5 is a perspective view of the second ground shield 182 in accordance with an exemplary embodiment. In an exemplary embodiment, the second ground shield 182 is stamped and formed from a stock piece of metal material. The second ground shield 182 includes a main body 300 configured to extend along the left side 162 of the dielectric holder 142 (both shown in FIG. 2). The main body 300 includes a plurality of left side rails 302 separated by gaps 304, the left side rails 302 being interconnected by struts 306 that span the gaps 304 between the rails 302.

The second ground shield 182 includes mating portions 310 defined by mating beams 312 at a mating end 314 of the main body 300. The mating portions 310 are configured to be mated with corresponding mating portions of the mating electrical connector (for example, the C-shaped mating ground shields 114, shown in FIG. 1). In an exemplary embodiment, the second ground shield 182 includes side mating beams 312*a* and top mating beams 312*b* configured to extend along the sides and the tops of the corresponding signal contacts 124. The mating beams 312 may be deflectable mating beams, such as spring beams. Optionally, the mating beams 312 are configured to be received inside the corresponding C-shaped mating ground shields 114 of the mating electrical connector 106. Alternatively, the mating beams 312 are configured to extend along the outside of the corresponding C-shaped mating ground shields 114 of the mating electrical connector.

The second ground shield 182 includes mounting portions 316 defined by compliant pins 318 at a mounting end 320 of the main body 300. The mounting portions 316 are configured to be terminated to the circuit board 104 (shown in FIG. 1). For example, the mounting portions 316 are configured to be received in plated vias in the circuit board 104.

The left side rails 302 are configured to provide shielding around corresponding signal contacts 124 (shown in FIG. 2). For example, in an exemplary embodiment, the left side rails 302 have side strips 322 configured to extend along the left side 162 of the dielectric holder 142, and connecting strips 324 configured to extend into the dielectric holder 142 and extend between adjacent signal contacts 124. The connecting strips 324 are bent perpendicular to and extend from the corresponding side strips 322. The left side rails 302 form right angle shielded spaces that receive corresponding signal contacts 124 to provide electrical shielding along the sides of the signal contacts 124 and between the signal contacts 124, such as above and/or below corresponding signal contacts 124. The struts 306 interconnect the left side rails 302 to hold the relative positions of the left side rails 302. The gaps 304 are defined between the left side rails 302 and generally follow the paths of the left side rails 302.

In an exemplary embodiment, each connecting strip 324 includes a commoning feature 326 for electrically connecting to the first ground shield 180 (shown in FIG. 4). In the illustrated embodiment, the commoning features 326 are commoning slots in the connecting strips 324 and commoning tabs; however, other types of commoning features may be used in alternative embodiments, such as channels, spring beams, clips, and the like. The commoning features 326 may be deflectable to engage and securely couple the second ground shield 182 to the first ground shield 180 when mated thereto.

The left side rails 302 are configured to extend along and follow the paths of the signal contacts 124, such as between the mating end 128 and the mounting end 130 (both shown in FIG. 1) of the electrical connector 102. For example, the left side rails 302 may transition from the mating end 314 to the mounting end 320 and have different segments or portions 328 that are angled relative to each other as the left side rails 302 transition between the ends 314, 320.

Figure 6:
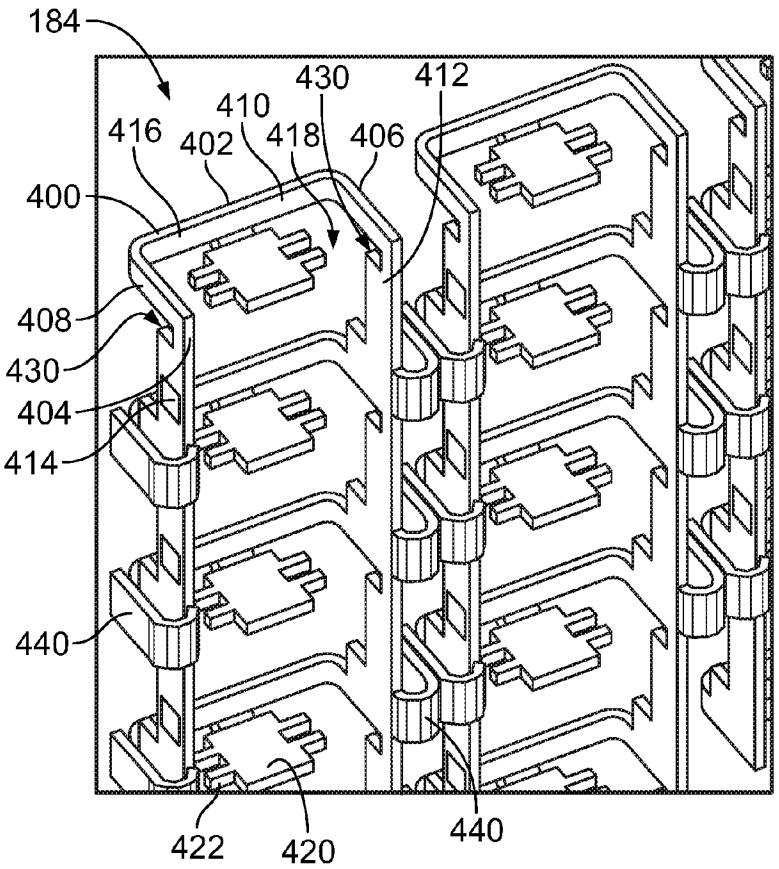
FIG. 6 is a perspective view of ground clips of contact modules in accordance with an exemplary embodiment.

FIG. 6 is a perspective view of portions of ground clips 184 in accordance with an exemplary embodiment. Each ground clip 184 includes a main body 400 extending between a front 402, a rear 404 and opposite sides 406, 408. The main body 400 is stamped and formed from a stock piece of metal material. The ground clip 184 is used to electrically connect the first and second ground shields 180, 182 (shown in FIG. 2). The ground clip 184 provides electrical shielding for the signal contacts 124 (shown in FIG. 2).

In an exemplary embodiment, the ground clip 184 includes a center wall 410 and first and second side walls 412, 414 extending from the center wall 410. The center wall 410 may be defined by a plurality of center strips 416 extending between the side walls 412, 414. The center strips 416 are separated by openings 418 that receive the signal contacts 124. The center strips 416 pass between pairs of the signal contacts 124 and provide shielding between the pairs of signal contacts 124.

The first and second side walls 412, 414 are formed out of plane from the center wall 410. For example, the first and second side walls 412, 414 are bent perpendicular to the center wall 410 and folded rearward. The center wall 410 is configured to span across the width of the dielectric holder 142 (shown in FIG. 2) and may be located forward of the mating end 150 (shown in FIG. 2) of the dielectric holder 142. The first and second side walls 412, 414 may at least partially extend along the right and left sides 160, 162 (both shown in FIG. 2) of the dielectric holder 142 or may be positioned forward of the mating end 150.

In an exemplary embodiment, the ground clip 184 includes connecting tabs 420 used to connect to the first ground shield 180 and/or the second ground shield 182. The connecting tabs 420 are used to mechanically and/or electrically connect the ground clip 184 to the ground shields 180, 182. In the illustrated embodiment, the connecting tabs 420 extend rearward from the center strips 416; however the connecting tabs 420 may be positioned at other locations in alternative embodiments. Each center strip 416 may include at least one connecting tab 420. Optionally, the connecting tabs 420 include fingers 422 configured to engage the first ground shield 180 and/or the second ground shield 182. The fingers 422 may be deflectable.

The first and second side walls 412, 414 define connecting slots 430 that receive portions of the first and second ground shields 180, 182 to connect the ground clip 184 to the first and second ground shields 180, 182. In the illustrated embodiment, the connecting slots 430 are formed below the corresponding center strips 416; however other positions are possible in alternative embodiments.

The first side wall 412 and/or the second side wall 414 include commoning beams 440 extending therefrom. The commoning beams 440 are used to electrically connect the ground clip 184 to an adjacent ground clip 184 that is part of the adjacent contact module 122. The commoning beams 440 may be deflectable. In the illustrated embodiment, the commoning beams 440 extend from the rear 404 and are bent around toward the front 402. The commoning beams 440 may be spring beams.

Figure 7:
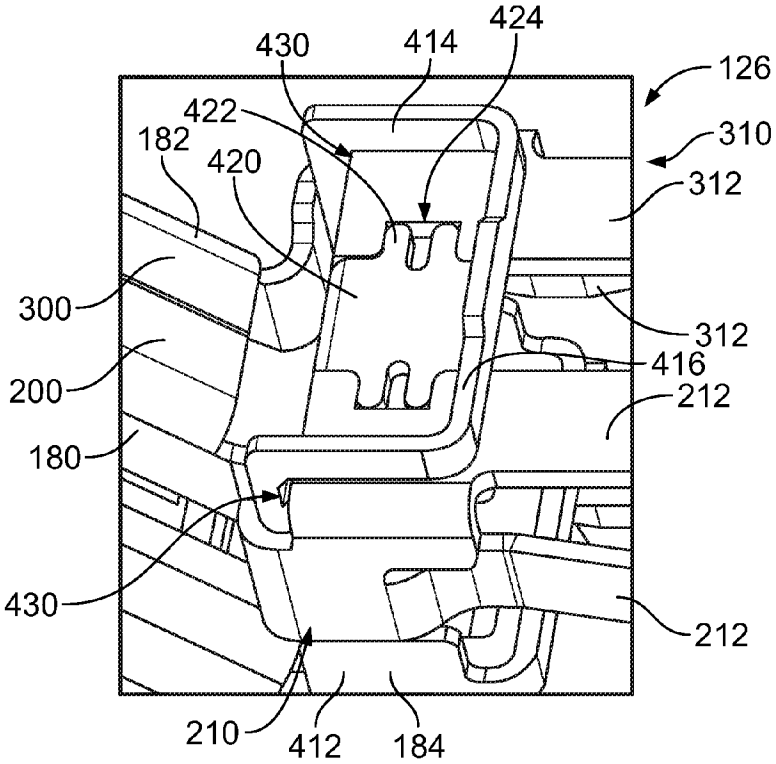
FIG. 7 is a perspective view of a portion of a shield structure of the contact module showing the ground clip coupled to the ground shields.

FIG. 7 is a perspective view of a portion of the shield structure 126 showing the ground clip 184 coupled to the first and second ground shields 180, 182. The ground clip 184 is located forward of the main bodies 200, 300 of the ground shields 180, 182. In an exemplary embodiment, the ground clip 184 is coupled to the mating beams 212, 312 of the first and second ground shields 180, 182. For example, the ground clip 184 is coupled to each of the mating beams 212, 312 to electrically common all of the mating beams 212, 312.

In the illustrated embodiment, the connecting tabs 420 are positioned between the mating beams 212, 312 and engage the mating beams 212, 312 to mechanically and electrically connect the first and second ground shields 180, 182. For example, the fingers 422 of the connecting tabs 420 are received in connecting slots 424 in the mating beams 212, 312. The fingers 422 may clip into the connecting slots 424 of the mating beams 212, 312 to physically hold the mating beams 212, 312. The connecting tabs 420 bridge between the mating beams 212, 312 and provide electrical shielding in the space between the mating beams 212, 312. The mating beams 212, 312 are received in the connecting slots 430 in the first and second side walls 412, 414, respectively, to lock the positions of the mating beams 212, 312 into the ground clip 184. The first and second side walls 412, 414 may be positioned inside of the mating portions 210, 310 and may engage the interior surfaces of the mating portions 210, 310 to electrically connect thereto. The ground clip 184 may thus directly engage each of the mating portions 210, 310 of the first and second ground shields 180, 182. The center strips 416 may bridge between the mating beams 212, 312, such as over the tops of the mating beams 212, 312 to electrically connect the first and second ground shields 180, 182.

In an exemplary embodiment, the mating portions 210, 310 are cantilevered forward from the main bodies 200, 300. The ground clip 184 may be used to support and hold the mating beams 212, 312, such as to position the mating beams 212, 312 for mating with the mating ground shield 114 (shown in FIG. 1). For example, the ground clip 184 vertically ties (for example, up-and-down) the mating portions 210 of the first ground shield 180 together to hold the physical positions of the mating portions 210 relative to each other and to electrically connect the mating portions 210 of the first ground shield 180 together. The ground clip 184 vertically ties (for example, up-and-down) the mating portions 310 of the second ground shield 182 together to hold the physical positions of the mating portions 310 relative to each other and to electrically connect the mating portions 310 of the second ground shield 182 together. The ground clip 184 may be used to horizontally tie (for example, side-to-side) the mating portions 210 of the first ground shield 180 to the corresponding mating portions 310 of the second ground shield 182.

Figure 8:
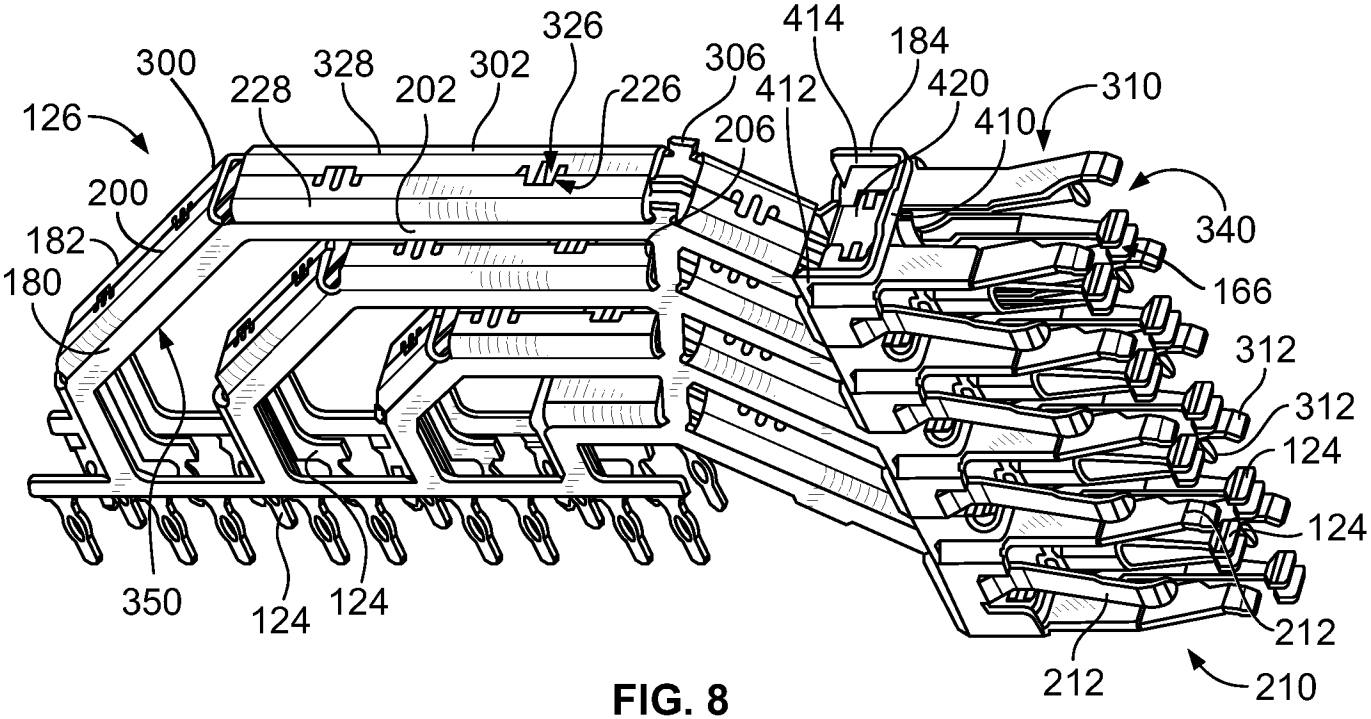
FIG. 8 illustrates the shield structure showing the ground shields and the ground clip.

FIG. 8 illustrates the shield structure 126 showing the first and second ground shields 180, 182 coupled together and the ground clip 184 arranged between the first and second ground shields 180, 182. The dielectric holder 142 (shown in FIG. 2) is removed for clarity to illustrate the shield structure 126. The mating portions 210, 310 of the first and second ground shields 180, 182 are configured to be electrically coupled to the mating ground shields 114 (shown in FIG. 1) in a mating zone 340. For example, the mating beams 212, 312 are configured to be received inside the C-shaped area of the mating ground shields 114 and engage the interior surfaces of the walls of the mating ground shields 114. The ground clip 184 is provided adjacent the mating zone 340, such as at the roots of the mating beams 212, 312. The ground clip 184 may be used to secure the first and second ground shields 180, 182 together, such as at the mating beams 212, 312.

The first and second ground shields 180, 182 are mated together during assembly to mechanically and electrically connect the first and second ground shields 180, 182. As noted above, the ground clip 184 is used to mechanically and/or electrically connect the first and second ground shields 180, 182 at the mating end. In an exemplary embodiment, the ground clip 184 extends between the first and second ground shields 180, 182 to electrically connect the mating portions 210 of the first ground shield 180 and the mating portions 310 of the second ground shield 182 rearward of the mating portions of the first and second ground shields 180, 182. The first and second ground shields 180, 182 are also mechanically and/or electrically connected along the main bodies 200, 300 by the commoning features 226, 326. For example, the commoning tabs of the commoning feature 226 are received in the commoning slot of the commoning feature 326. The commoning tabs may be deflectable such that the commoning tabs press outward against surfaces that define the commoning slot to secure the first and second ground shields 180, 182 together. A slot or channel may be provided in the commoning tab to allow the fingers to be deflectable. The walls defining the commoning slot may be undercut and angled to snapably retain the commoning feature 226 in the commoning feature 326.

In an exemplary embodiment, each rail 202, 302 includes multiple commoning features 226, 326 to make periodic, reliable electrical connections therebetween. For example, each portion 228, 328 may include at least one commoning feature 226, 326. The commoning features 226, 326 may be generally spaced at approximately 3-5 mm apart to achieve good electrical performance in a desired range, such as between 30-40 GHz; however other spacings or other target ranges may be achieved in other embodiments.

When assembled, the ground shields 180, 182 form C-shaped hoods 350 covering three sides of each pair of signal contacts 124. For example, the hoods 350 cover both the right and left sides as well as the tops of the signal contacts 124 to shield the pair of signal contacts 124 from other pairs of signal contacts 124. The rails 202, 302 below the pair of signal contacts 124 shield the fourth side of the pair of signal contacts 124 such that the pair is shielded on all four sides. The first and second ground shields 180, 182 thus provide circumferential shielding around the pairs of signal contacts 124. The circumferential shielding is provided around each pair of signal contacts 124 for substantially the entire length of the transition portions 170 (shown in FIG. 2) of the signal contacts. For example, in the illustrated embodiment, the only break in the shielding is provided at the struts 206, 306; however, the short gaps do not detrimentally affect the signal performance, even at high electrical speeds. The first and second ground shields 180, 182 provide shielding in all line-of-sight directions between all adjacent pairs of signal contacts 124, including pairs of signal contacts 124 in adjacent contact modules 122. Optionally, the bottom of the inner-most pair remains unshielded; however, the signal performance of the signal contacts 124 of the inner-most pair remains largely unaffected by having the one side unshielded. Optionally, a shield may be provided at the unshielded side of the inner-most pair.

In an exemplary embodiment, during assembly the ground clip 184 is configured to be mounted onto the dielectric holder 142 (FIG. 2) from the front of the dielectric holder 142 before the first ground shield 180 is assembled. The first ground shield 180 is configured to be mounted onto the dielectric holder 142 from the first side 160 of the dielectric holder 142 after the ground clip 184 is assembled. The second ground shield 182 may be the last component mounted to the dielectric holder 142; however, the components may be assembled in other orders in alternative embodiments.

The ground clip 184 together with the first and second ground shields 180, 182 provide circumferential shielding of the signal contacts 124 at the mating end, such as at the roots of the mating beams 212, 312. For example, the first and second ground shields 180, 182 and the first and second side walls 412, 414 extend along sides of the pairs of signal contacts 124, and the ground clip 184 extends along tops and bottoms of the pairs of signal contacts 124, forming a generally rectangular box around each pair of signal contacts 124. The center strips 410 and the connecting tabs 420 extend along the tops and the bottoms of the pairs of signal contacts 124. The top mating beams 212, 312 may additionally extend along the tops and the bottoms of the pairs of signal contacts 124. The mating portions 166 are thus electrically shielded at the mating zone 340. The circumferential shielding is provided above, below and along opposite sides of each pair of signal contacts 124 at the mating end 150 (FIG. 2) of the dielectric holder 142. The circumferential shielding not only extends along the length of the transition portions 170 of the signal contacts 124, but is also located immediately forward of the dielectric holder 142, such as between the mating ground contacts 114 (FIG. 1) and the dielectric holder 142.

The stamped and formed first and second ground shields 180, 182 and the ground clip 184 are cost effective to manufacture, as compared to conventional plated plastic conductive holders. The stamped and formed first and second ground shields 180, 182 and the ground clip 184 provide electrical shielding in all directions for each pair-in-row pair of signal contacts 124, as compared to conventional ground shields that only extend along the sides of the signal contacts and not above or below the pair of signal contacts.

Figure 9:
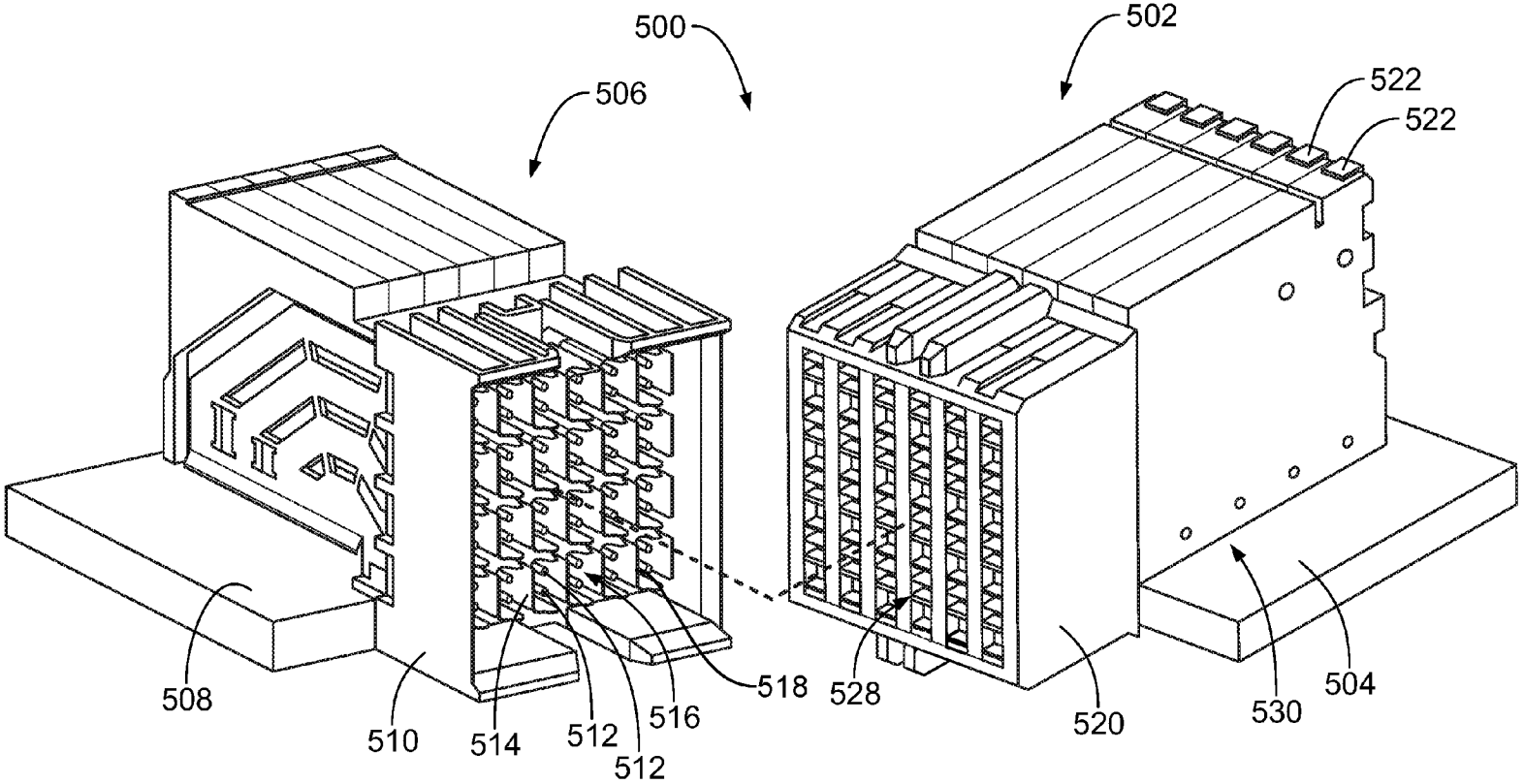
FIG. 9 is a front perspective view of an electrical connector system formed in accordance with an exemplary embodiment.

FIG. 9 is a front perspective view of an electrical connector system 500 formed in accordance with an exemplary embodiment. The electrical connector system 500 is similar to the electrical connector system 100; however, the electrical connector system 500 includes a pair-in-column connector as opposed to the pair-in-row electrical connector 102 of the electrical connector system 100. The shielding structure of the electrical connector system 500 is similar to the shielding structure 126 of the electrical connector system 100; however, shapes and orientations of some of the components of the shielding structure may differ from the pair-in-row embodiment.

The connector system 500 includes an electrical connector 502 configured to be mounted to a circuit board 504, and a mating electrical connector 506 which may be mounted to a circuit board 508. The mating electrical connector 506 includes a housing 510 holding a plurality of mating signal contacts 512 and mating ground shields 514. The mating signal contacts 512 are arranged in pairs 516. Each mating ground shield 514 extends around corresponding mating signal contacts 512, such as the pairs 516 of mating signal contacts 512. In the illustrated embodiment, the mating ground shields 514 are C-shaped having three walls extending along three sides of each pair of mating signal contacts 512. The mating ground shields 514 may extend to edges 518.

The electrical connector 502 includes a housing 520 that holds a plurality of contact modules 522. The contact modules 522 each include a plurality of signal contacts 524 (shown in FIG. 10) that define signal paths through the electrical connector 502. In an exemplary embodiment, each contact module 522 has a shield structure 526 (shown in FIG. 10) for providing electrical shielding for the signal contacts 524. The electrical connector 502 includes a mating end 528, such as at a front of the electrical connector 502, and a mounting end 530, such as at a bottom of the electrical connector 502. The signal contacts 524 are arranged in pairs and the pairs are arranged in columns (pair-in-column signal contacts).

Figure 10:
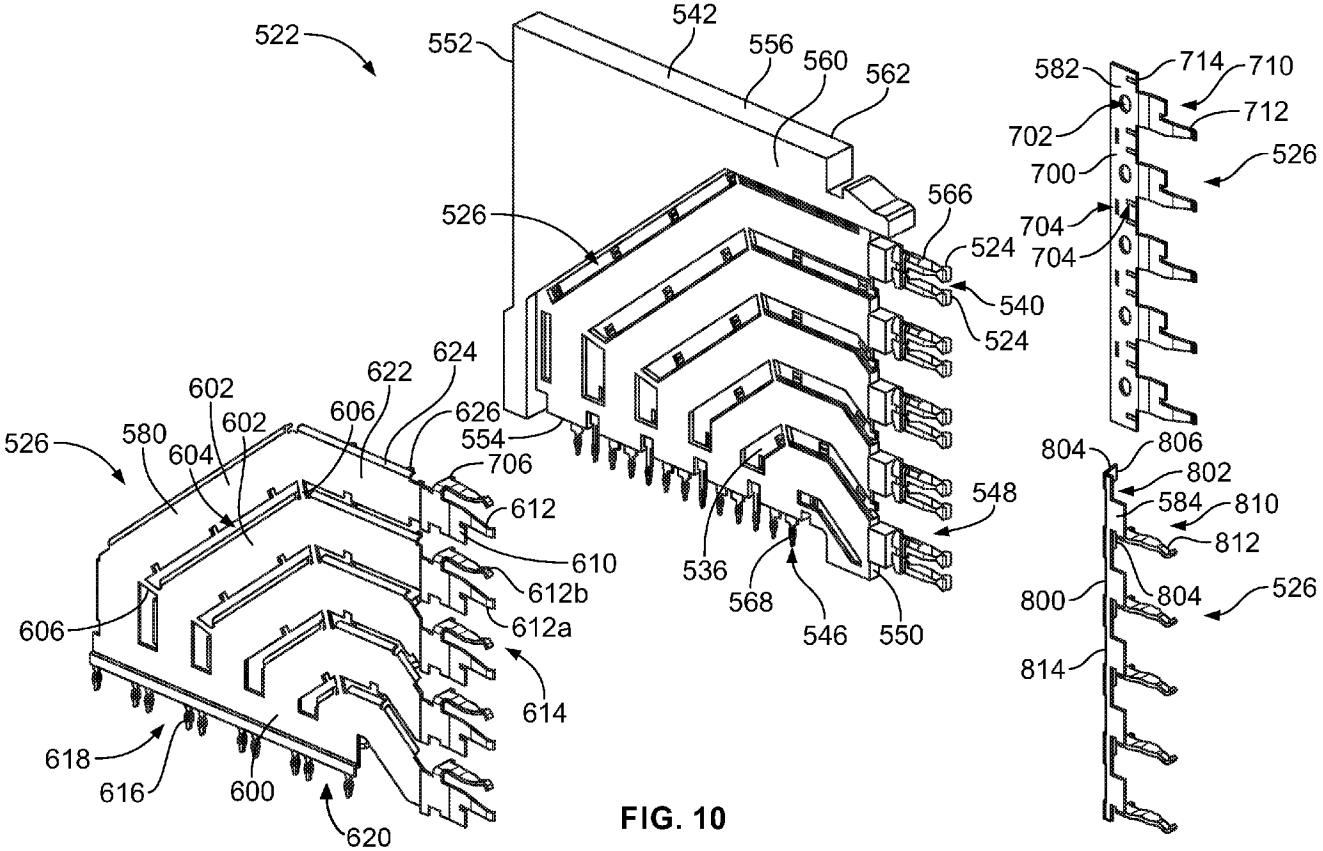
FIG. 10 is an exploded view of a contact module of the electrical connector system shown in FIG. 9 in accordance with an exemplary embodiment.

FIG. 10 is an exploded view of one of the contact modules 522 in accordance with an exemplary embodiment. The signal contacts 524 are arranged in an array with ground contacts or guard traces 536. The guard traces 536 are arranged between corresponding signal contacts 524, such as between pairs 540 of the signal contacts 524. The guard traces 536 form part of the shield structure 526. The guard traces 536 provide electrical shielding between the signal contacts 524, such as between the pairs 540 of the signal contacts 524. In an exemplary embodiment, the signal contacts 524 and the guard traces 536 are stamped and formed from a common sheet of metal, such as a leadframe.

The contact module 522 includes a frame assembly having the signal contacts 524 and the guard traces 536 with a dielectric frame or holder 542 holding the signal contacts 524 and the guard traces 536. The dielectric holder 542 generally surrounds the signal contacts 524 and the guard traces 536 along substantially the entire lengths thereof between a mounting end 546 at the bottom and a mating end 548 at the front. The shield structure 526 is held by and/or configured to be coupled to the dielectric holder 542 to provide electrical shielding for the signal contacts 524. The shield structure 526 provides circumferential shielding for each pair 540 of signal contacts 524 along at least a majority of a length of the signal contacts 524, such as substantially an entire length of the signal contacts 524.

The dielectric holder 542 has a mating end 550 at a front configured to be loaded into the housing 520 (shown in FIG. 9), a rear 552 opposite the mating end 550, a mounting end 554 at a bottom, which optionally may be adjacent to the circuit board 504 (shown in FIG. 9), and a top 556 generally opposite the mounting end 554. The dielectric holder 542 also includes first and second sides 560, 562, such as a right side 560 and a left side 562.

Each signal contact 524 has a mating portion 566 extending forward from the mating end 550 of the dielectric holder 542 and a mounting portion 568 extending downward from the mounting end 554. Each signal contact 524 has a transition portion between the mating and mounting portions 566, 568.

In an exemplary embodiment, the shield structure 526 includes first and second ground shields 580, 582 and a ground clip 584. The first and second ground shields 580, 582 and the ground clip 584 are each separate stamped and formed pieces configured to be mechanically and electrically connected together to form part of the shield structure 526. The first and second ground shields 580, 582 and/or the ground clip 584 are configured to be electrically connected to the guard traces 536 to electrically common all of the components of the shield structure 526. In various embodiments, the ground clip 584 may be integral with (for example, stamped and formed with) the second ground shield 582 and/or the first ground shield 580. The first and second ground shields 580, 582 and the ground clip 584 cooperate to provide circumferential shielding for each pair 540 of signal contacts 524 at the mating end 548. When assembled, the first ground shield 580 is positioned along the right side 560 of the dielectric holder 542 and the second ground shield 582 is positioned along the left side 562 of the dielectric holder 542, while the ground clip 584 is provided at the mating end 550 of the dielectric holder 542. The first and second ground shields 580, 582 electrically connect the contact module 522 to the mating electrical connector 506, such as to the mating ground shields 514 thereof (shown in FIG. 9).

The first ground shield 580 is stamped and formed from a stock piece of metal material. In an exemplary embodiment, the first ground shield 580 includes a main body 600 configured to extend along the right side 560 of the dielectric holder 542 (although the ground shield 580 may be reversed and designed to extend along the left side 562 in other various embodiments). The main body 600 includes a plurality of rails 602 separated by gaps 604, the rails 602 being interconnected by struts 606 that span the gaps 604 between the rails 602. The rails 602 are configured to extend along and follow the paths of the signal contacts 524.

The first ground shield 580 includes mating portions 610 defined by mating beams 612 at a mating end 614 of the main body 600. The mating portions 610 are configured to be mated with corresponding mating portions of the mating electrical connector 506 (for example, the C-shaped mating ground shields 514, shown in FIG. 9). In an exemplary embodiment, the first ground shield 580 includes side mating beams 612*a* and top mating beams 612*b* configured to extend along the sides and the tops of the mating portions 566 of corresponding signal contacts 524.

The first ground shield 580 includes mounting portions 616 defined by compliant pins 618 at a mounting end 620 of the main body 600. The mounting portions 616 are configured to be terminated to the circuit board 504 (shown in FIG. 9). For example, the mounting portions 616 are configured to be received in plated vias in the circuit board 504.

The rails 602 are configured to provide shielding along the sides of the signal contacts 524 of the corresponding pair 540. For example, in an exemplary embodiment, the rails 602 have side strips 622 configured to extend along the right side 560 of the dielectric holder 542 and connecting strips 624 configured to extend into the dielectric holder 542 and extend between adjacent pairs 540 of the signal contacts 524. The connecting strips 624 extend into the dielectric holder 542 to directly engage the guard traces 536. The side strips 622 generally follow the paths of the transition portions of the signal contacts 524. The side strips 622 provide shielding along the sides of the pair 540 of signal contacts 524. In an exemplary embodiment, each connecting strip 624 includes one or more commoning features 626 for electrically connecting the first ground shield 580 to the guard traces 536. In the illustrated embodiment, the commoning features 626 are commoning tabs, and may be referred to hereinafter as commoning tabs 626, which extend outward from the connecting strips 624; however, other types of commoning features may be used in alternative embodiments, such as channels, slots, spring beams, and the like.

The second ground shield 582 is stamped and formed from a stock piece of metal material. The second ground shield 582 includes a main body 700 configured to extend along the left side 562 of the dielectric holder 542. The main body 700 may be generally planar and configured to attach to the mating end 550 of the dielectric holder 542; however, the main body 700 may extend between the mating end 548 and the mounting end 546 in other various embodiments, similar to the first ground shield 580. The second ground shield 582 includes openings 702 for mounting to the dielectric holder 542 from the left side 562; however, the second ground shield 582 may include other types of mounting features in alternative embodiments. The second ground shield 582 includes connecting slots 704 used for coupling the second ground shield 582 to the first ground shield 580 and to the ground clip 584, respectively; however other types of connecting features may be used in alternative embodiments to electrically connect the second ground shield 582 with the first ground shield 580 and/or the ground clip 584. The connecting slots 704 receive connecting tabs 706 of the first ground shield 580 and connecting tabs 806 of the ground clip 584. The connecting slots 704 may be sized and shaped to electrically connect to the connecting tabs 706, 806. For example, the connecting slots 704 may have crush tabs or bumps to engage the tabs 706, 806 by an interference fit. The connecting tabs 706, 806 define contact points between the first and second ground shields 580, 582 and the ground clip 584. The contact points may be offset, such as at different distances from the mating end 550 of the dielectric holder 542.

The second ground shield 582 includes mating portions 710 defined by mating beams 712 at a mating end 714 of the main body 700. The mating portions 710 are configured to be mated with corresponding mating portions of the mating electrical connector (for example, the C-shaped mating ground shields 514, shown in FIG. 9). In an exemplary embodiment, the mating beams 712 are side mating beams configured to extend along the sides of the corresponding signal contacts 524; however the mating beams 712 may extend along other portions of the signal contacts 524. The mating beams 712 may be deflectable mating beams, such as spring beams.

The ground clip 584 is stamped and formed from a stock piece of metal material. The ground clip 584 includes a main body 800 configured to extend along the mating end 550 of the dielectric holder 542. The main body 800 may be generally planar and configured to attach to the mating end 550 of the dielectric holder 542. The ground clip 584 includes openings 802 between pads 804 that receive the mating portions 566 of the signal contacts 524. The pads 804 define center strips of shielding material that are positioned between adjacent pairs 540 of the signal contacts 524. The pads 804 are configured to directly engage the second ground shield 582. In an exemplary embodiment, the connecting tabs 806 extend from the pads 804 to engage the second ground shield 582. The pads 804 are configured to cover and span across the mating end 550 of the dielectric holder 542. The pads 804 may be configured to directly engage the guard traces 536 to electrically connect the ground clip 584 to the guard traces 536.

The ground clip 584 includes mating portions 810 defined by mating beams 812. The mating portions 810 are configured to be mated with corresponding mating portions of the mating electrical connector (for example, the C-shaped mating ground shields 514, shown in FIG. 9). In an exemplary embodiment, the mating beams 812 are bottom mating beams configured to extend along the bottom of the corresponding signal contacts 524; however the mating beams 812 may extend along other portions of the signal contacts 524. The mating beams 812 may be deflectable mating beams, such as spring beams. The mating beams 812 may extend from a first side wall 814 of the ground clip 584. The side wall 814 may be bent perpendicular to the main body 800 and the pads 804 and extend forward from the main body 800.

Figure 11:
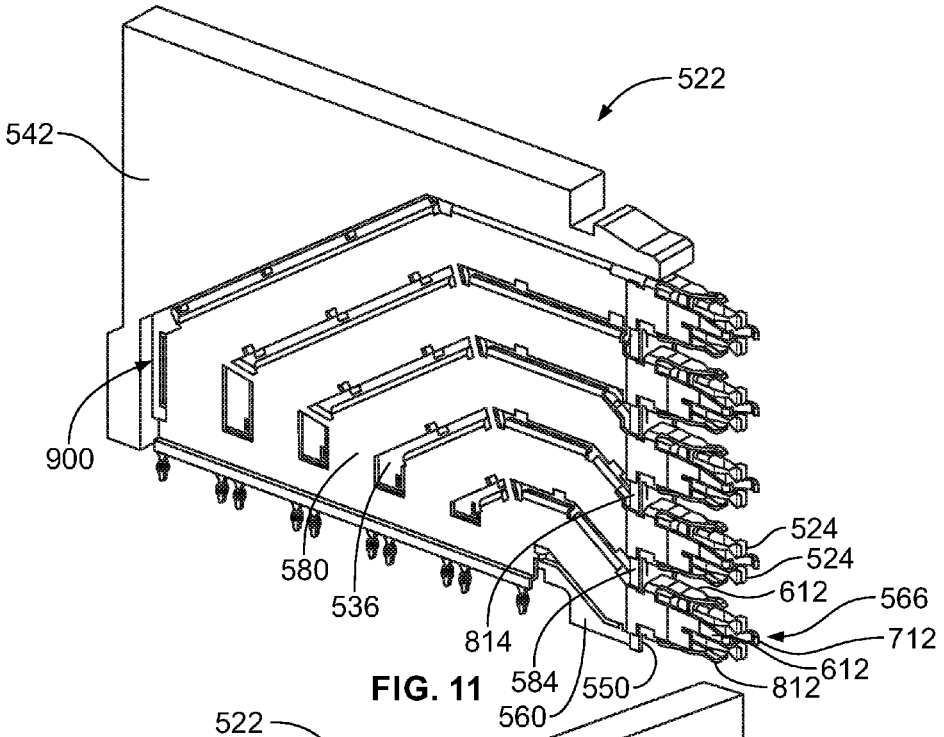
FIG. 11 is a side perspective view of the contact module in an assembled state showing a ground shield and ground clip in accordance with an exemplary embodiment.
Figure 12:
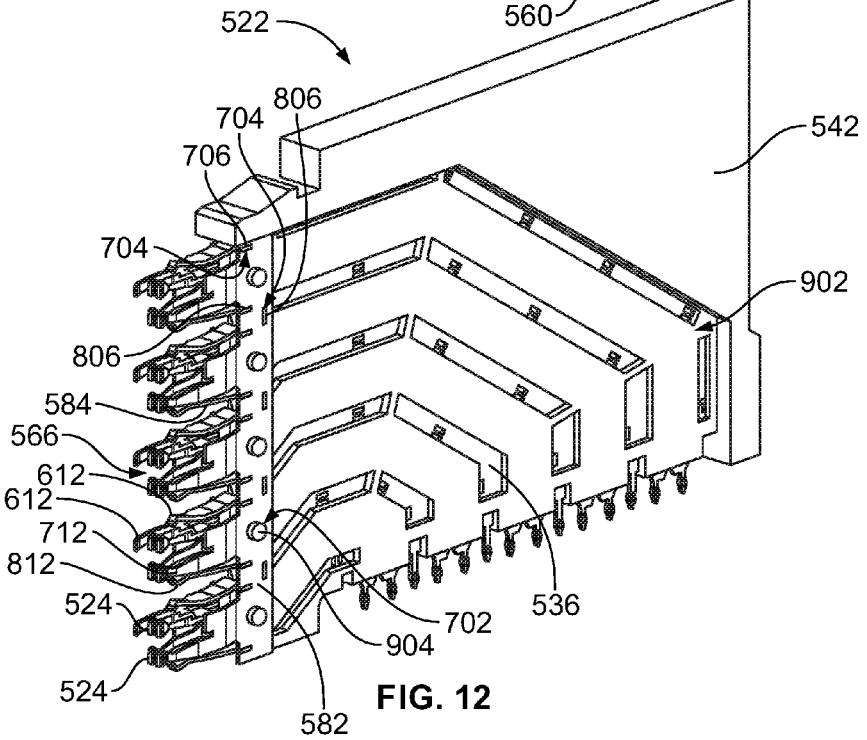
FIG. 12 is a side perspective view of the contact module in an assembled state showing a ground shield and ground clip in accordance with an exemplary embodiment.
Figure 13:
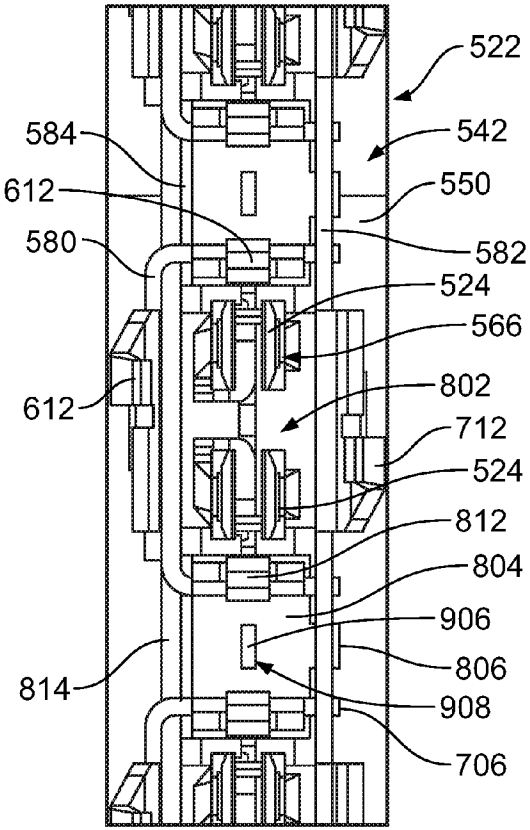
FIG. 13 is a front view of a portion of the contact module showing the ground shields and the ground clip.

FIG. 11 is a side perspective view of the right side of the contact module 522 in an assembled state showing the first ground shield 580 and the ground clip 584. FIG. 12 is a side perspective view of the left side of the contact module 522 in an assembled state showing the second ground shield 582 and the ground clip 584. FIG. 13 is a front view of a portion of the contact module 522 showing the first and second ground shields 580, 582 and the ground clip 584. The first and second ground shields 580, 582 are received in pockets 900, 902 (shown in FIGS. 11 and 12, respectively) and may be mechanically connected to the dielectric holder 542. For example, posts 904 (shown in FIG. 12) are received in corresponding openings 702.

The first ground shield 580 is electrically connected to the guard traces 536 and provides shielding for the signal contacts 524. The second ground shield 582 is electrically connected to the first ground shield 580 and the ground clip 584. For example, as shown in FIG. 12, the connecting tabs 706, 806 are received in the connecting slots 704. As shown in FIG. 13, the pads 804 of the ground clip 584 are positioned forward of the mating end 550 of the dielectric holder 542. The pads 804 are positioned between the pairs of signal contacts 524. The signal contacts 524 pass through the openings 802. Connecting tabs 906 of the guard traces 536, which protrude forward of the mating end 550 of the dielectric holder 542, are received in corresponding connecting slots 908 in the pads 804 to electrically connect the ground clip 584 to the guard traces 536.

In an exemplary embodiment, during assembly the ground clip 584 is configured to be mounted onto the dielectric holder 542 from the front of the dielectric holder 542 before the first ground shield 580 is assembled. The first ground shield 580 is configured to be mounted onto the dielectric holder 542 from the first side 560 of the dielectric holder 542 after the ground clip 584 is assembled. Optionally, the first ground shield 580 may be permanently fixed to the ground clip 584 after assembly, such as by spot welding to the side wall 814 or by using other fasteners or securing means, such as connecting tabs or clips. The second ground shield 582 may be the last component mounted to the dielectric holder 542, such as by connecting to the connecting tabs 706, 806. However, the components may be assembled in other orders in alternative embodiments.

When assembled, the ground clip 584 together with the first and second ground shields 580, 582 provide circumferential shielding of the signal contacts 524 at the mating end. For example, the side mating beams 612, 712 of the first and second ground shields 580, 582 and the side wall 814 of the ground clip 584 extend along the sides of the pairs of signal contacts 524, and the top mating beam 612 of the first ground shield 580 and the bottom mating beam 812 of the ground clip 584 extend along the tops and the bottoms of the pairs of signal contacts 524, forming a generally rectangular box around each pair of signal contacts 524. Additionally, the pads 804 of the ground clip 584 extend along the mating end 550 of the dielectric holder 542, generally between the pairs of signal contacts 524, to provide shielding between the pairs of signal contacts 524. The mating portions 566 are thus electrically shielded at the mating zone. The circumferential shielding not only extends along the length of the transition portions of the signal contacts 524 but is also located immediately forward of the dielectric holder 542, such as between the mating ground contacts 514 (shown in FIG. 9) and the dielectric holder 542.

Figure 14:
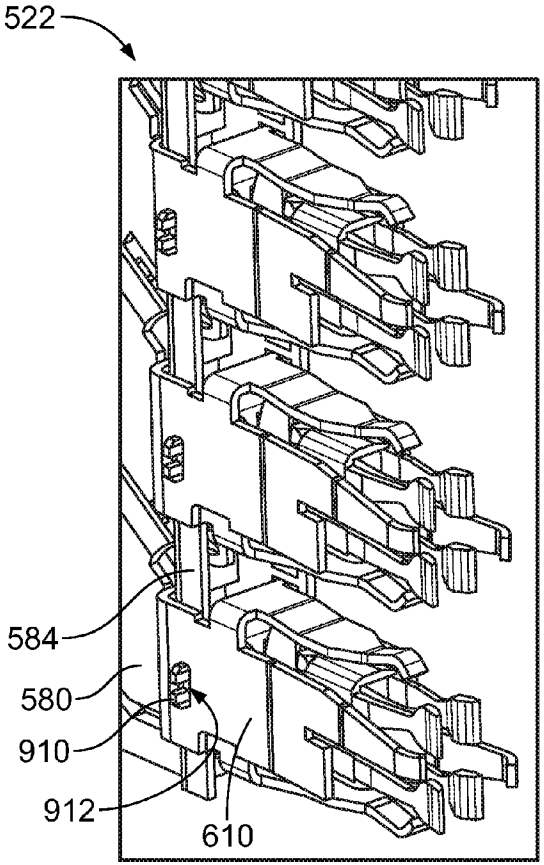
FIG. 14 illustrates a portion of the contact module showing the ground clip in accordance with an exemplary embodiment.

FIG. 14 illustrates a portion of the contact module 522 showing an embodiment with the ground clip 584 securely coupled to the first ground shield 580. The ground clip 584 includes connecting tabs 910 received in connecting slots 912 formed in the mating portions 610. The connecting tabs 910 are mechanically and electrically connected to the first ground shield 580.

Figure 15:
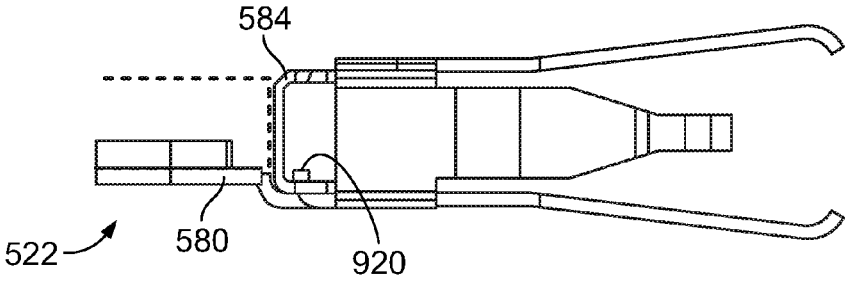
FIG. 15 illustrates a portion of the contact module showing the ground clip in accordance with an exemplary embodiment.

FIG. 15 illustrates a portion of the contact module 522 showing an embodiment with the ground clip 584 securely coupled to the first ground shield 580. The first ground shield 580 includes connecting tabs 920 received in connecting slots (not shown) formed in the ground clip 584. The connecting tabs 920 are mechanically and electrically connected to the ground clip 584.

Figure 16:
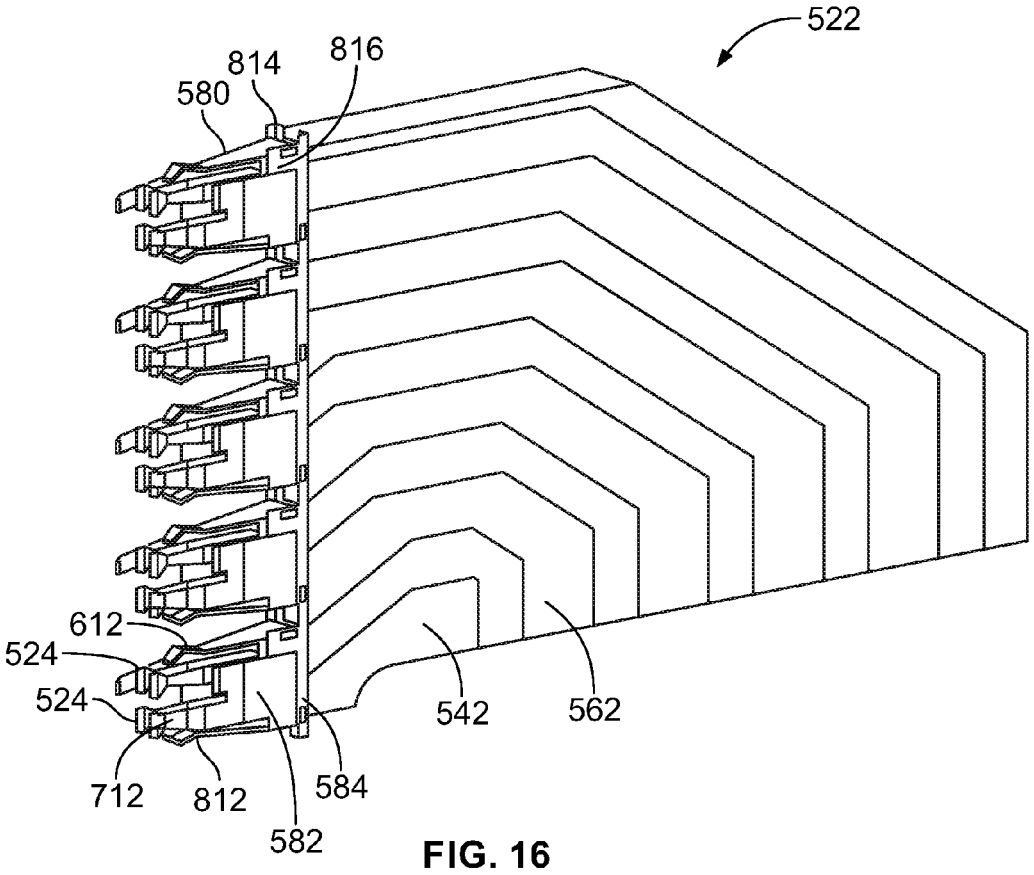
FIG. 16 is a perspective view of a portion of the contact module showing the ground clip in accordance with an exemplary embodiment.
Figure 17:
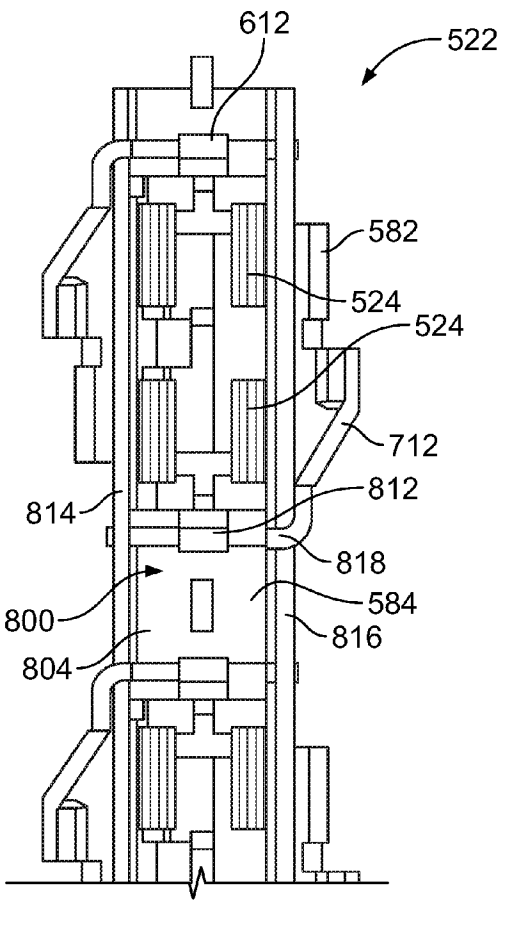
FIG. 17 is a front view of a portion of the contact module showing the ground clip in accordance with an exemplary embodiment.

FIG. 16 is a perspective view of a portion of the contact module 522 showing an embodiment with the ground clip 584 integral with the second ground shield 582. FIG. 17 is a front view of a portion of the contact module 522 showing an embodiment with the ground clip 584 integral with the second ground shield 582. The ground clip 584 includes the main body 800, including the pads 804, the first side wall 814 and a second side wall 816. The second side wall 816 forms part of the second ground shield 582 on the second side 562 of the dielectric holder 542. The mating beams 712, 812 are formed from a tab 818 stamped and formed out of the first side wall 814 and bent across the front of the ground clip 584 and bent again along the second side of the ground clip 584 to engage the second side wall 816. The first and second side walls 814, 816 provide electrical shielding along the sides of the signal contacts 524, and the top mating beams 612 and bottom mating beams 812 provide electrical shielding along the tops and bottoms of the pairs of signal contacts 524.

Figure 18:
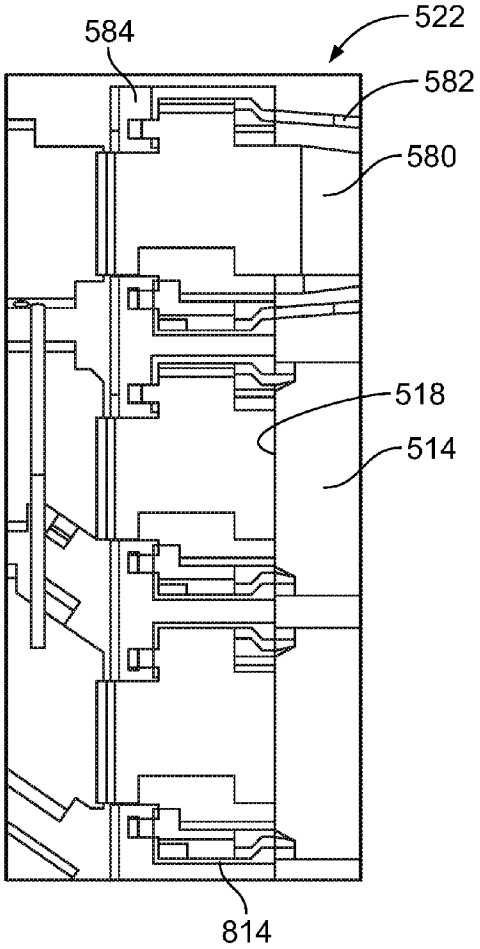
FIG. 18 is a side view of a portion of the contact module showing the ground clip in accordance with an exemplary embodiment.
Figure 19:
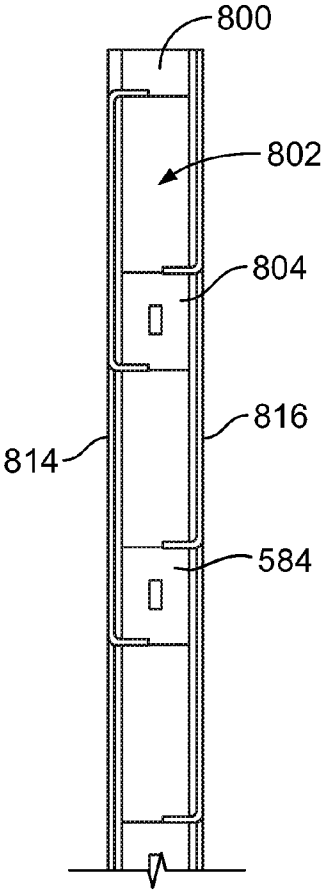
FIG. 19 is a front view of the ground clip shown in FIG. 18.

FIG. 18 is a side view of a portion of the contact module 522 showing an embodiment with the ground clip 584 having the first and second side walls 814, 816 (shown in FIG. 19); however, the top and bottom mating beams are formed from the first and second ground shields 580, 582. FIG. 19 is a front view of the ground clip 584 shown in FIG. 18. The ground clip 584 includes the main body 800, including the pads 804, the first side wall 814 and the second side wall 816. The first and second side walls 814, 816 and the pads 804 form the rectangular opening 802 that receives the pairs of signal contacts (not shown). FIG. 18 shows the ground clip 584 relative to some of the mating ground shields 514, such as immediately adjacent the edges 518.

Figure 20:
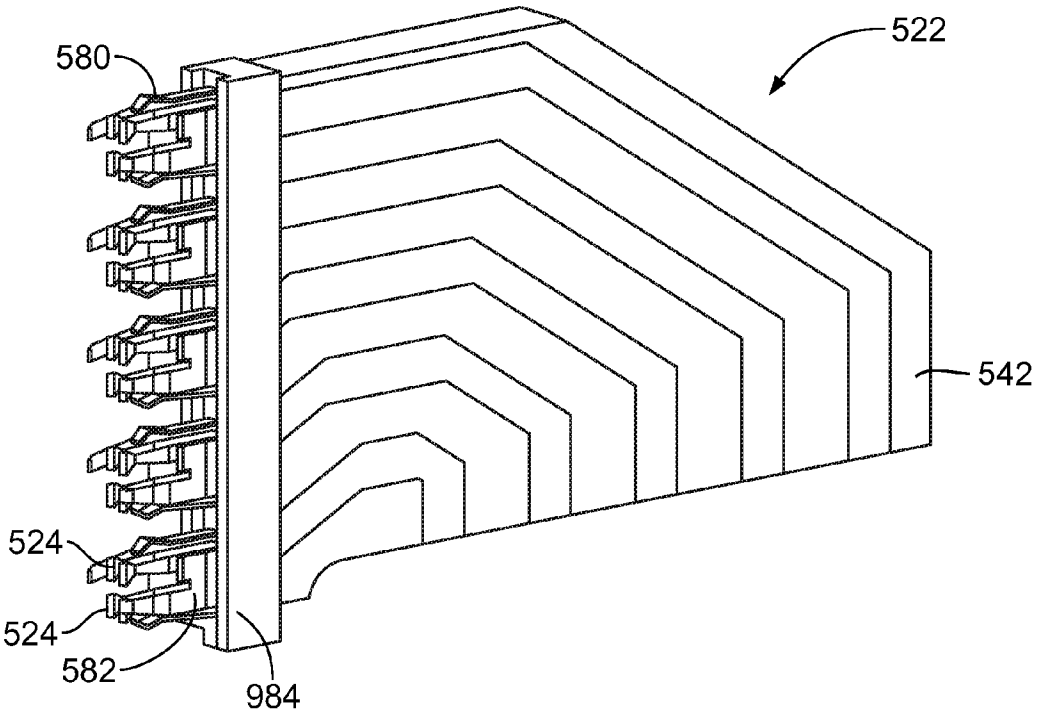
FIG. 20 is a perspective view of a portion of the contact module showing the ground clip in accordance with an exemplary embodiment.

FIG. 20 is a perspective view of a portion of the contact module 522 showing an embodiment with a ground clip 984 overmolded over the first and second ground shields 580, 582. The ground clip 984 may be overmolded using a conductive material, such as a plated plastic or a metalized plastic. The ground clip 984 electrically connects the ground shields 580, 582. The ground clip 984 provides electrical shielding around the pairs of signal contacts 524 at the mating zone, such as immediately forward of the dielectric holder 542.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

What is claimed is:

1. A contact module comprising:

a dielectric holder having first and second sides extending between a mating end and a mounting end;

signal contacts being held by the dielectric holder, the signal contacts having mating portions extending forward of the mating end, mounting portions extending from the mounting end for termination to a circuit board, and transition portions extending through the dielectric holder between the mating portion and the mounting portion; and a shield structure coupled to the dielectric holder and providing electrical shielding for the signal contacts, the shield structure having a first ground shield provided at the first side of the dielectric holder and a second ground shield provided at the second side of the dielectric holder, the first ground shield having mating portions extending forward of the mating end of the dielectric holder and providing electrical shielding for the mating portions of the signal contacts, the second ground shield having mating portions extending forward of the mating end of the dielectric holder and providing electrical shielding for the mating portions of the signal contacts, the shield structure having a ground clip at least partially covering the mating end of the dielectric holder and extending between the first and second sides, the ground clip electrically connecting the mating portions of the first ground shield and the mating portions of the second ground shield immediately forward of the mating end of dielectric holder.

2. The contact module of claim 1, wherein the ground clip directly engages each of the mating portions of the first ground shield and each of the mating portions of the second ground shield.

3. The contact module of claim 1, wherein the ground clip vertically ties each of the mating portions of the first ground shield together to hold the physical positions of the mating portions relative to each other and to electrically connect each of the mating portions of the first ground shield together, and wherein the ground clip vertically ties each of the mating portions of the second ground shield together to hold the physical positions of the mating portions relative to each other and to electrically connect each of the mating portions of the second ground shield together.

4. The contact module of claim 3, wherein the ground clip horizontally ties the mating portions of the first ground shield together with the corresponding mating portions of the second ground shield.

5. The contact module of claim 1, wherein the ground clip includes a center wall and a side wall extending generally perpendicular from the center wall, the side wall being electrically connected to the first ground shield, the center wall spanning the mating end of the dielectric holder.

6. The contact module of claim 1, wherein the ground clip is configured to be mounted onto the dielectric holder from the front of the dielectric holder before the first and second ground shields are assembled, the first ground shield being configured to be mounted onto the dielectric holder from the first side of the dielectric holder after the ground clip is assembled.

7. The contact module of claim 1, wherein the ground clip includes connecting slots receiving corresponding connecting tabs of the first ground shield to couple the ground clip to the first ground shield.

8. The contact module of claim 1, wherein the ground clip includes connecting tabs engaging the first ground shield to electrically connect the ground clip to the first ground shield.

9. The contact module of claim 8, wherein the connecting tabs include deflectable fingers received in connecting slots in the first ground shield to mechanically secure the ground clip to the first ground shield.

10. The contact module of claim 1, wherein the ground clip is positioned between the dielectric holder and mating ground shields of a mating electrical connector.

11. The contact module of claim 1, wherein the signal contacts are arranged in pairs carrying differential signals, the ground clip and the first and second ground shields provide circumferential shielding above, below and along opposite sides of each pair of signal contacts at the mating end of the dielectric holder.

12. The contact module of claim 1, wherein the ground clip includes a connecting beam extending therefrom configured to engage and electrically connect to an adjacent contact module.

13. The contact module of claim 1, wherein the ground clip is integral with at least one of the first ground shield and the second ground shield.

14. The contact module of claim 1, wherein the ground clip electrically engages a plurality of guard traces between corresponding signal contacts.

15. The contact module of claim 1, wherein the ground clip includes a first contact point electrically connected with the first ground shield and a second contact point electrically connected with the second ground shield, the second contact point being offset forward of the first contact point.

16. The contact module of claim 1, wherein the ground clip includes mating portions extending forward of the mating end of the dielectric holder and provides electrical shielding for the mating portions of the signal contacts.

17. A shield structure for a contact module having a dielectric holder holding signal contacts arranged in pairs carrying differential signals, the signal contacts having mating portions extending forward of the dielectric holder for mating with a mating electrical connector, the shield structure comprising:

a first ground shield having a main body configured to extend along a first side of the dielectric holder, the main body having a plurality of rails separated by gaps, the rails having side strips configured to extend along the side of the dielectric holder, the rails having connecting strips configured to extend into the dielectric holder, each rail having a mating portion extending from the main body forward of the dielectric holder for providing electrical shielding for the mating portions of the corresponding signal contacts;

a second ground shield having a main body configured to extend along a second side of the dielectric holder, the second ground shield having mating portions extending from the main body forward of the dielectric holder for providing electrical shielding for the mating portions of the corresponding signal contacts; and a ground clip configured to at least partially cover a mating end of the dielectric holder, the ground clip extending between the first and second ground shields to electrically connect the mating portions of the first ground shield and the mating portions of the second ground shield rearward of the mating portions of the first and second ground shields.

18. The shield structure of claim 17, wherein the ground clip directly engages each of the mating portions of the first ground shield and each of the mating portions of the second ground shield.

19. The shield structure of claim 17, wherein the ground clip includes a center wall and a side wall extending generally perpendicular from the center wall, the side wall being electrically connected to the first ground shield, the center wall configured to span the mating end of the dielectric holder.

20. An electrical connector comprising:

a housing having a mating end, contact modules arranged in a contact module stack received in and extending from the housing for termination to a circuit board;

wherein each contact module comprises:

a dielectric holder having first and second sides extending between a mating end and a mounting end;

signal contacts being held by the dielectric holder, the signal contacts having mating portions extending forward of the mating end, mounting portions extending from the mounting end for termination to a circuit board, and transition portions extending through the dielectric holder between the mating and mounting portions; and a shield structure coupled to the dielectric holder providing electrical shielding for the signal contacts, the shield structure having a first ground shield provided at the first side of the dielectric holder and a second ground shield provided at the second side of the dielectric holder, the first ground shield having mating portions extending forward of the mating end of the dielectric holder and providing electrical shielding for the mating portions of the signal contacts, the second ground shield having mating portions extending forward of the mating end of the dielectric holder and providing electrical shielding for the mating portions of the signal contacts, the shield structure having a ground clip at least partially covering the mating end of the dielectric holder and extending between the first and second sides to electrically connect each of the mating portions of the first ground shield and each of the mating portions of the second ground shield immediately forward of the mating end of dielectric holder.

* * * * *